US006650050B1

(12) United States Patent
Kyushima et al.

(10) Patent No.: US 6,650,050 B1
(45) Date of Patent: Nov. 18, 2003

(54) PHOTOMULTIPLIER TUBE

(75) Inventors: Hiroyuki Kyushima, Hamamatsu (JP); Hideki Shimoi, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/937,077

(22) PCT Filed: Apr. 24, 2000

(86) PCT No.: PCT/JP00/02655

§ 371 (c)(1),
(2), (4) Date: Sep. 21, 2001

(87) PCT Pub. No.: WO00/65633

PCT Pub. Date: Nov. 2, 2000

(30) Foreign Application Priority Data

Apr. 23, 1999 (JP) ..... 11-116381

(51) Int. Cl.[7] ..... H01J 43/00; H01J 43/22

(52) U.S. Cl. ..... 313/533; 313/103 R; 313/105 R; 313/532

(58) Field of Search ..... 313/533, 532, 313/534, 535, 103 R, 105 R

(56) References Cited

U.S. PATENT DOCUMENTS 5,410,211 A * 4/1995 Kyushima ..... 313/103 R
5,491,380 A * 2/1996 Kyushima et al. ..... 313/533
5,504,386 A * 4/1996 Kyushima et al. ..... 313/103 R
5,532,551 A * 7/1996 Kyushima et al. ..... 313/533
5,744,908 A * 4/1998 Kyushima ..... 313/533

FOREIGN PATENT DOCUMENTS

EP 0 622 828 A1 11/1994
EP 0 686 996 A1 12/1995
JP 11-3677 A 1/1999

* cited by examiner

*Primary Examiner*—Sandra O'Shea
*Assistant Examiner*—Dalei Dong
(74) *Attorney, Agent, or Firm*—Oliff & Berridge, PLC

(57) ABSTRACT

In a photomultiplier tube 1, an etching technique is used to form electron multiplying holes 8*a* in plate-shaped dynodes 8 that are stacked in multiple layers. To perform this etching process, a pattern frame 22 is disposed around a plate-shaped dynode substrate 20. A bridge portion 23 is provided for connecting the pattern frame 22 to an edges 20*a* of the dynode substrate 20. The dynode substrate 20 is masked, and the etching process is performed to form a plurality of electron multiplying holes 8*a* in the dynode substrate 20. Subsequently, the bridge portion 23 is cut near the dynode substrate 20, leaving a small bridge remainder 8*c* on the edge 8*b* of the dynode 8. In order to suppress noise generated by these bridge remainders, the bridge remainders 8*c* on neighboring dynodes 8 are arranged in positions such that straight lines parallel to the dynode stacking direction and passing through the bridge remainder 8*c* do not overlap each other, thereby further improving the basic characteristics of the photomultiplier tube 1.

9 Claims, 10 Drawing Sheets

PHOTOMULTIPLIER TUBE

TECHNICAL FIELD

The present invention relates to a photomultiplier tube that converts weak incident light on a faceplate into electrons and performs detection using the electron multiplication effect created by dynodes that are stacked in multiple stages.

BACKGROUND ART

Japanese Patent-Application Publications Nos. HEI-6-314551 and HEI-6-310084 describe conventional photomultiplier tubes. The photomultiplier tubes include an electron multiplying section formed of dynodes that are stacked in multiple-layers and U-shaped connection terminals formed on the dynodes that connect the dynodes to stem pins. The connection terminals provided on each dynode are positioned such that lines passing through each connection terminal parallel to the dynode stacking direction do not overlap, in order to prevent electrical discharges from occurring between connection terminals. The dynodes are joined by welding together neighboring dynode plates. The positions of the welding seams are arranged not to overlap also.

DISCLOSURE OF THE INVENTION

Positioning the connection terminals and the welding seams in a manner described above is an effective method for increasing performance in the photomultiplier tube. In order to further improve the basic characteristics of the photomultiplier tube, however, it is necessary to also consider burrs that are generated when forming each dynode by an etching technique. The etching method for forming dynodes has been disclosed in Japanese Patent-Application Publications Nos. HEI-6-314552 and HEI-5-182631. However, this etching technique does not consider burrs that are generated during the process.

In view of the foregoing, it is an object of the present invention to provide a photomultiplier tube capable of suppressing noise generated due to burrs.

The photomultiplier tube of the present invention comprises a faceplate, a photocathode housed in a hermetically sealed vessel for emitting electrons in response to light incident on the faceplate, an electron multiplying section for multiplying the electrons emitted from the photocathode, and an anode for transmitting output signals based on the electrons multiplied by the electron multiplying section. The electron multiplying section includes a plurality of plate-shaped dynodes stacked in layers. Each dynode is formed with electron multiplying holes by etching and has an edge portion provided with bridge remainders. The bridge remainders are positioned such that-straight lines extending parallel to the stacking direction of the dynodes while through the bridge remainders on neighboring dynodes do not overlap each other.

In this type of photomultiplier tube, an etching technique is used to form electron multiplying holes in the plate-shaped dynodes that are stacked in multiple layers. To perform this etching process, a substrate surrounding a plate-shaped dynode and being connected to the same by a bridge portion is prepared. The dynode substrate is masked, and the etching process is performed to form a plurality of electron multiplying holes in the dynode substrate. Subsequently, the bridge portion is cut to form a dynode capable of being incorporated in the photomultiplier tube.

Inevitably, part of the bridge portion remains on the edge of the dynode. It has been confirmed that when the dynodes are stacked with this bridge remainder, electrical discharge occurs between bridge remainders when the same are aligned in the stacking direction. This phenomenon becomes more marked as the interval between dynodes becomes smaller and has been confirmed through experiment by the inventors to generate noise in the photomultiplier tube. Therefore, the bridge remainders are arranged on neighboring dynodes in positions such that straight lines parallel to the dynode stacking direction and passing through each bridge remainder do not overlap, thereby further improving the basic characteristics of the photomultiplier tube. This technique is particularly effective when producing a thin type electron multiplying section. The present invention is predicated on the existence of burrs (bridge remainders) on the dynodes and recognizes that these burrs are an important element that cannot be ignored when trying to create a precision photomultiplier tube.

In the photomultiplier tube of the present invention, the bridge remainders are formed on edges along the edge portions of the dynodes. With this configuration, it is possible to form many arrangements of bridge remainders to suit various situations. For example, all bridge remainders can be positioned such that straight lines parallel to the dynode stacking direction and passing through each bridge remainder do not overlap.

In the photomultiplier tube of the present invention, the bridge remainders are formed on corners along the edge portions of the dynodes. With this construction, the bridge remainders can be arranged in the corners of every other dynode in the stacking direction.

In the photomultiplier tube of the present invention, the bridge remainders are positioned such that straight lines parallel to the stacking direction of the dynodes that pass through the bridge remainders overlap each other in every other dynode layer. With this construction, the bridge remainders can be separated by at least the thickness of a dynode.

In the photomultiplier tube of the present invention, all the bridge remainders are positioned such that straight lines parallel to the stacking direction of the dynodes that pass through the bridge remainders do not overlap each other. With this construction, the space between bridge remainders can be increased.

In the photomultiplier tube of the present invention, the bridge remainders are offset in a stair-shaped arrangement. With this construction, the space between bridge remainders can be increased more than the thickness of a dynode.

BRIEF DESCRIPTION OF THE DRAWINGS

FIG. 7(*b*) is a cross-sectional view along the line VII(b)—VII(b) in FIG. 7(*a*);

FIG. 8(*b*) is a cross-sectional view along the line VIII (b)—VIII(b) in FIG. 8(*a*);

FIG. 8(*c*) is a cross-sectional view taken along the line VIII(c)—VIII(c) in FIG. 8(*a*);

FIG. 9(*b*) is a cross-sectional view taken along the line IX(b)—IX(b) in FIG. 9(*a*);

FIG. 10(*b*) is a cross-sectional view taken along the line X(b)—X(b) in FIG. 10(*a*);

FIG. 10(*c*) is a cross-sectional view taken along the line X(c)—X(c) in FIG. 10(*a*);

BEST MODE FOR CARRYING OUT THE INVENTION

A photomultiplier tube according to a preferred embodiment of the present invention will be described while referring to the accompanying drawings.

Figure 1:
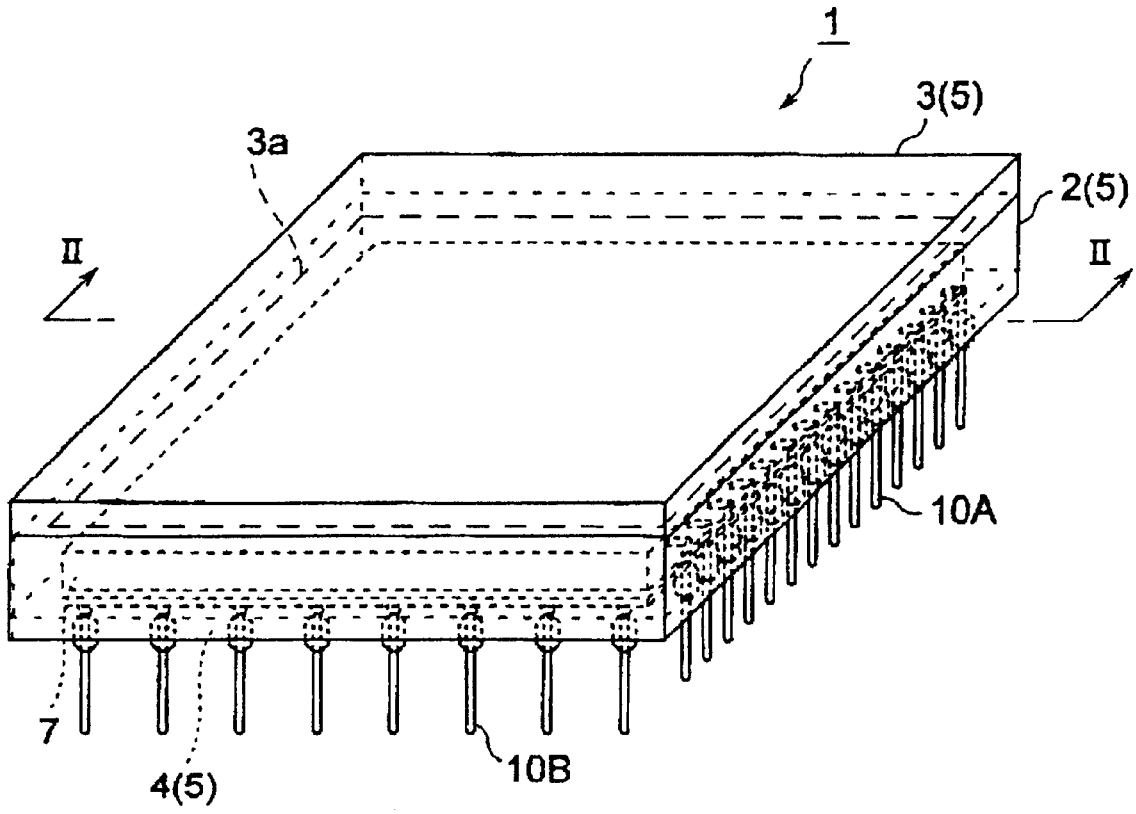
FIG. 1 is a perspective view showing a photomultiplier tube according to an embodiment of the present invention.
Figure 2:
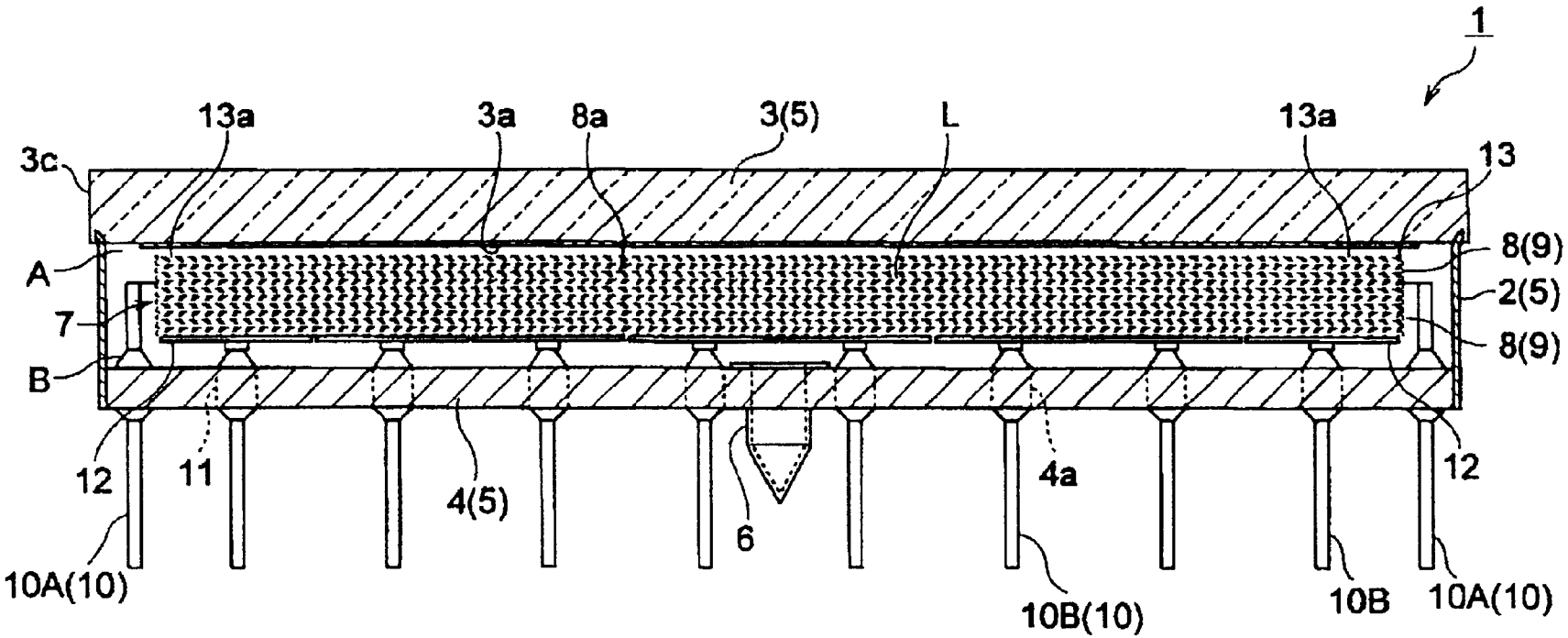
FIG. 2 is a cross-sectional view taken along the line II—II in FIG. 1.

FIG. 1 is a perspective view showing a photomultiplier tube according to the present invention. FIG. 2 is a cross-sectional view of the photomultiplier tube in FIG. 1. A photomultiplier tube 1 shown in the drawings includes a side tube 2 having a substantially squared cylindrical and formed of a metal material (such as Kovar metal and stainless steel). A glass faceplate 3 is fused to one open end A of the side tube 2. A photocathode 3*a* for converting light to electrons is formed on the inner surface of the faceplate 3. The photocathode 3*a* is formed by reacting alkali metal vapor with antimony that has been pre-deposited on the faceplate 3. A stem plate 4 formed of a metal material (such as Kovar metal and stainless steel) is welded to the other open end B of the side tube 2. The assembly of the side tube 2, the faceplate 3, and the stem plate 4 form a hermetically sealed vessel 5. The vessel 5 is ultrathin and has a height of approximately 10 mm.

A metal evacuating tube 6 disposed to protrude in the center of the stem plate 4. The evacuating tube 6 serves to evacuate the vessel 5 with a vacuum pump (not shown) after the photomultiplier tube 1 has been assembled. The evacuating tube 6 is also used as a tube for introducing alkali metal vapor into the vessel 5 when forming the photocathode 3*a*.

A layered electron multiplier 7 having a block shape is disposed inside the vessel 5. The electron multiplier 7 has an electron multiplying section 9 in which are stacked ten layers (stages) of plate-shaped dynodes 8, each having approximately the same shape. Stem pins 10 formed of Kovar metal penetrate the stem plate 4 and support the electron multiplier 7 in the vessel 5. The ends of each stem pin 10 are electrically connected to each dynode 8. Pinholes 4*a* are formed in the stem plate 4, enabling the stem pins 10 to penetrate the stem plate 4. Each of the pinholes 4*a* is filled with a tablet 11 formed of Kovar glass and serving to form a hermetic seal. Each stem pin 10 is fixed to the stem plate 4 via the tablet 11. The stem pins 10 include dynode pins 10A connected individually to each of the dynodes 8 and anode pins 10B connected individually to each of anodes 12, described next.

The anodes 12 are positioned below the electron multiplying section 9 in the electron multiplier 7 and fixed to the top ends of the anode pins 10B. A flat focusing electrode plate 13 is disposed between the photocathode 3*a* and the electron multiplying section 9 in the top stage of the electron multiplier 7. A plurality of slit-shaped openings 13*a* is formed in the focusing electrode plate 13. The openings 13*a* are arranged linearly in one direction. Slit-shaped electron multiplying holes 8*a* having the same number as the openings 13*a* are formed in each dynode 8 of the electron multiplying section 9. The electron multiplying holes 8*a* are arranged linearly in a direction perpendicular to the sheet surface of the drawing.

By arranging the electron multiplying holes 8*a* in each dynode 8 to define electron multiplying paths L extending along the direction of the stack such that the paths L correspond one-on-one with each opening 13*a* formed in the focusing electrode plate 13, a plurality of channels are defined in the electron multiplier 7. The anodes 12 are configured in an 8×8 arrangement, so that each anode 12 corresponds to a prescribed number of the channels. Since each anode 12 is connected to one of the anode pins 10B, individual output can be extracted via each anode pin 10B.

Hence, the electron multiplier 7 provides a plurality of linear channels. A prescribed voltage is supplied to the electron multiplying section 9 and the anodes 12 by a prescribed stem pin 10 connected to a bleeder circuit (not shown). The photocathode 3*a* and the focusing electrode plate 13 are set to the same potential, while the dynodes 8 and the anodes 12 are set to potentials increasing in order from the top stage. Accordingly, incident light on the faceplate 3 is converted to electrons at the photocathode 3*a*, and the electrons are injected into a prescribed channel by an electron lens effect that is created by the focusing electrode plate 13 and the dynode 8 at the first stage, i.e., the topmost layer of the electron multiplier 7. The electrons injected into the channel are multiplied through each stage of the dynodes 8 while passing through the electron multiplying paths L. Then, the electrons impinge on the anodes 12, enabling an individual output to be extracted from each anode 12.

Figure 3:
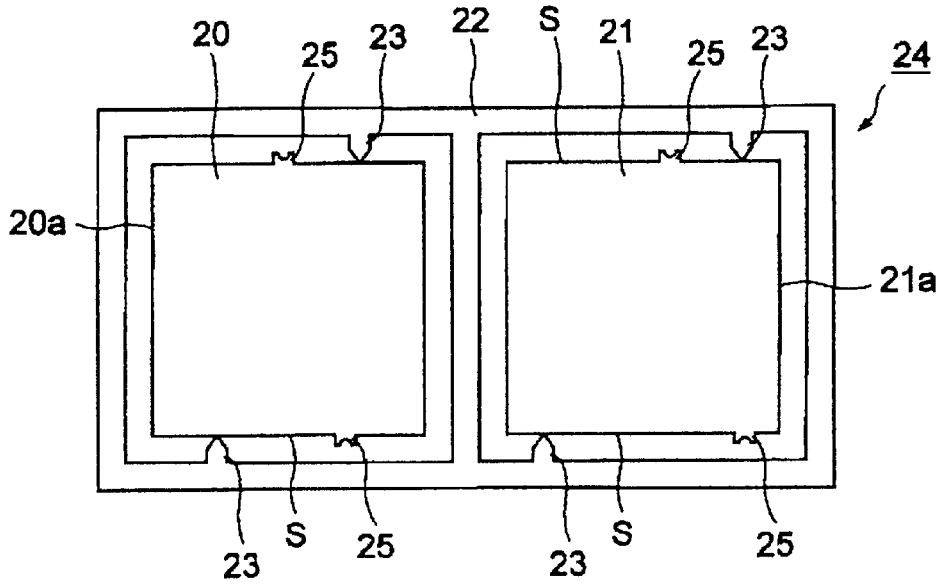
FIG. 3 is a plan view showing a first example of a base plate used in an etching process for forming dynodes.

Each plate-shaped dynode 8 stacked in the electron multiplying section 9 has a flat surface of 5 cm×5 cm and a thickness of 0.2 mm. A plurality of the electron multiplying holes 8*a* is formed in each dynode 8. The electron multiplying holes 8*a* are arranged at intervals of 0.5 mm. An etching technique is employed to form these micro-sized electron multiplying holes 8*a*. To perform this etching process, a base plate 24, such as that shown in FIG. 3, is prepared. The base plate 24 has a pattern frame 22 surrounding plate-shaped dynode substrates 20 and 21, each having a thickness of 0.2 mm. The pattern frame 22 is connected to edges 20*a* and 21*a* of the dynode substrates 20 and 21, respectively, by bridges 23.

Each of the dynode substrates 20 and 21 is supported in the base plate 24 by two opposing bridges 23. Therefore, the dynode substrates 20 and 21 are supported at two points inside the pattern frame 22. In this way, the bridges 23 are employed to support the dynode substrates 20 and 21 so as to prevent the same from falling out of the pattern frame 22 during the etching process. The base plate 24 is formed by a punching process.

Connection terminals 25 (see FIG. 3) are formed on the edges 20*a* and 21*a* of the dynode substrates 20 and 21 for connecting to the dynode pins 10A. The connection terminals 25 are formed at positions that differ for each stage of the dynodes 8, such that straight lines passing through the each connection terminals 25 in a direction parallel to the dynode stacking direction do not overlap. It is preferable to form the connection terminals 25 at predetermined positions on the base plate 24.

After placing a photomask over the surface of the dynode substrates 20 and 21, the etching process is performed for forming the plurality of electron multiplying holes 8*a* with a pitch of 0.5 mm in the dynode substrates 20 and 21. After the etching process, it is necessary to separate the dynode substrates 20 and 21 from the pattern frame 22.

Figure 4:
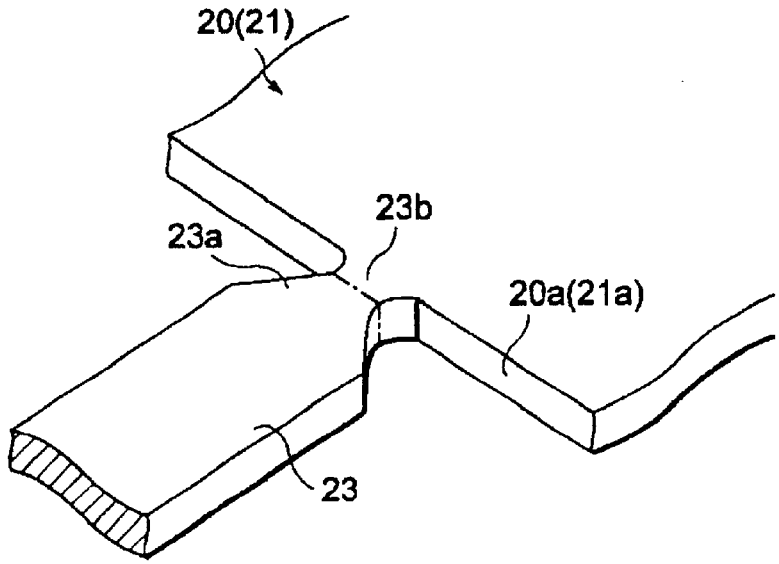
FIG. 4 is an enlarged perspective view showing the relevant part of FIG. 3.
Figure 5:
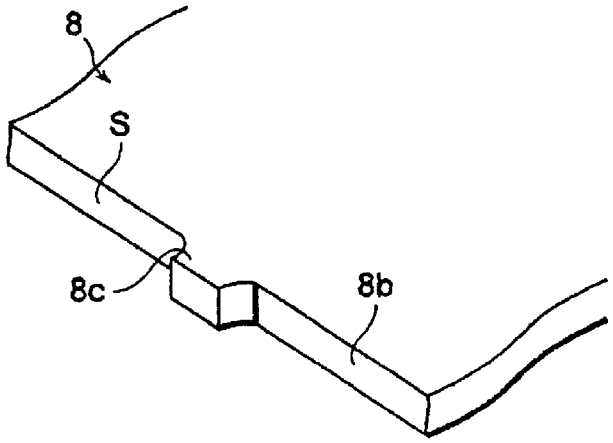
FIG. 5 is a perspective view showing a bridge remainder on a dynode.

As shown in FIGS. 3 and 4, the bridges 23 having a width of approximately 3 mm extend inward from the pattern frame 22 with the ends of the bridges 23 connecting to the dynode substrate 20, 21. The bridges 23 are connected to the dynode substrate 20, 21 at positions symmetrical in relation to the center point of the dynode substrate 20, 21. A linking portion 23*a* having a triangular shape is formed on the ends of the bridges 23. A tip 23*b* of the linking portion 23*a* connects to a side portion S on the edges 20*a*, 21*a* of the dynode substrate 20, 21. The tip 23*b* has a width of about 0.2 mm to be sufficient for supporting while allowing cutting.

The dynode substrates 20 and 21 are separated from the pattern frame 22 by cutting the tips 23*b* of the bridges 23 along the position indicated by the dotted line, thereby completing a dynode 8 that can be incorporated in the photomultiplier tube 1. After cutting the bridge 23, a small piece of the bridge 23 is left on each side portion S of the edge portion 8*b*. This remaining piece is referred to as a bridge remainder 8*c*. Since the bridges 23 are connected to the dynode substrate 20, 21 at symmetrical positions in relation to the center of the dynode substrate 20, 21, one bridge remainder 8*c* is formed on each of opposing edge portions 8*b*.

It has been confirmed through experiment that when dynodes 8 possessing these bridge remainders 8*c* are stacked together, a discharge is generated between neighboring bridge remainders 8*c* if the bridge remainders 8*c* are arranged such that straight lines passing through the each bridge remainder 8*c* in a direction parallel to the stacking direction overlap. This phenomenon is more remarkable the smaller the interval between the dynodes 8 and can generate noise.

Figure 6:
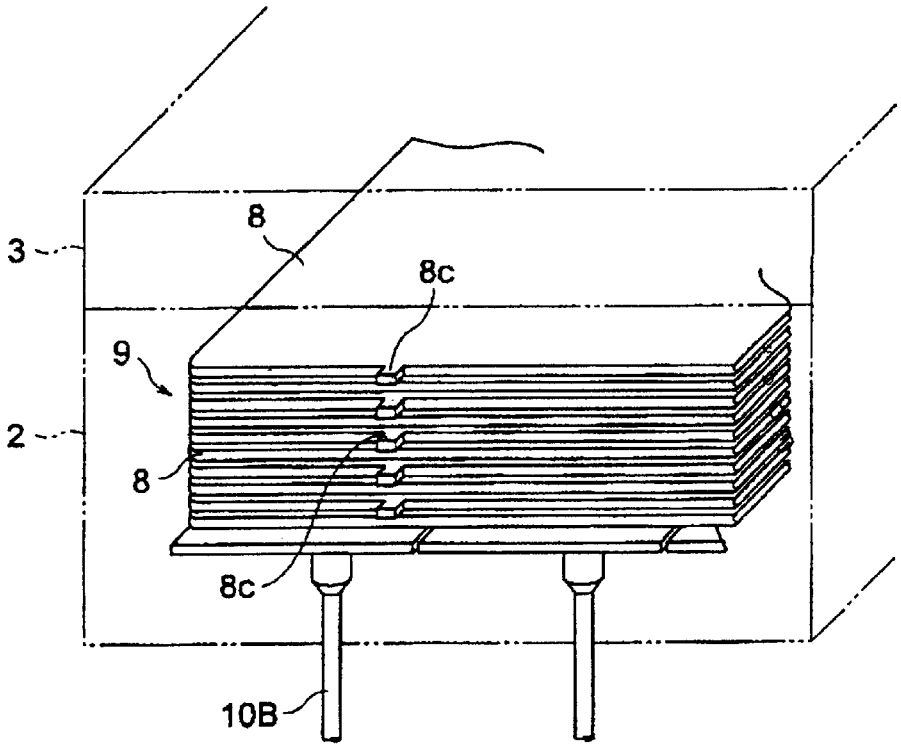
FIG. 6 is a perspective view showing a first arrangement of bridge remainders when dynodes of FIG. 5 are stacked in the photomultiplier tube.

The inventors of the present invention discovered a method for further improving the basic properties of the photomultiplier tube 1, where the bridge remainders 8*c* on neighboring dynodes 8 are arranged such that the straight lines passing through the bridge remainders 8*c* in the direction parallel to the stacking direction do not overlap. This method is particularly effective when forming a thin electron multiplying section 9. One specific example for arranging the bridge remainders 8*c* according to this method is to stack the dynodes 8 while rotating every other dynode 8 by 90 degrees around an imaginary axis parallel to the dynode stacking direction that penetrates the center of the dynodes 8. Since the bridge remainders 8*c* are formed on the pair of opposing edge portions 8*b*, the straight lines that is parallel to the dynode stacking direction and that pass through the edge portions 8*b* having the bridge remainders 8*c* of the neighboring dynodes 8 do not overlap. Accordingly, the bridge remainders 8*c* oppose other bridge remainders 8*c* in the stacking direction on every other dynode 8, as shown in FIG. 6, thereby doubling the distance between opposing bridge remainders 8*c*. As a result, it is possible to reliably avoid discharge that may occur between bridge remainders 8*c*.

Figure 7A:
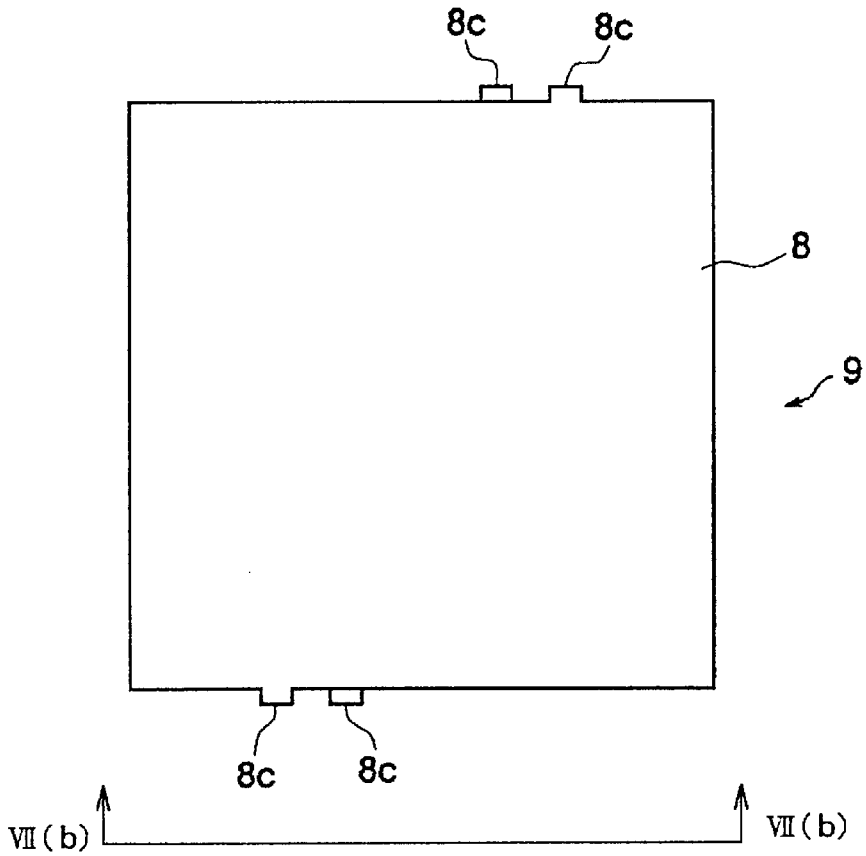
FIG. 7(*a*) is a plan view showing a second arrangement of bridge remainders.
Figure 7B:
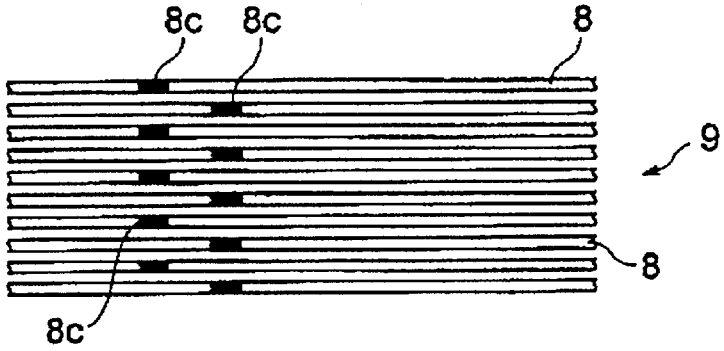

It is also possible, as shown in FIG. 3, to preset the bridges 23 at different positions on left and right dynode substrates 20 and 21 when etching the base plate 24. The distance between neighboring bridge remainders 8*c* can be increased by alternately stacking dynodes 8 manufactured by the dynode substrate 20 and the dynodes 8 manufactured by the dynode substrate 21 as shown in FIG. 7. Although the connection terminals 25 are not shown in FIG. 7, the positions of the connection terminals 25 are determined while considering the stacking layout of the dynodes 8 in each stage as described above, such that the dynode pins 10A extending downward from the connection terminals 25 are arranged at roughly equivalent intervals along one edge of the dynodes 8.

The effects of the above-described configuration were demonstrated through experiment. In the experiment, a breakdown voltage of 500 V was confirmed between stages of the dynodes 8. A noise reduction in the photomultiplier tube 1 was also confirmed.

Figure 8A:
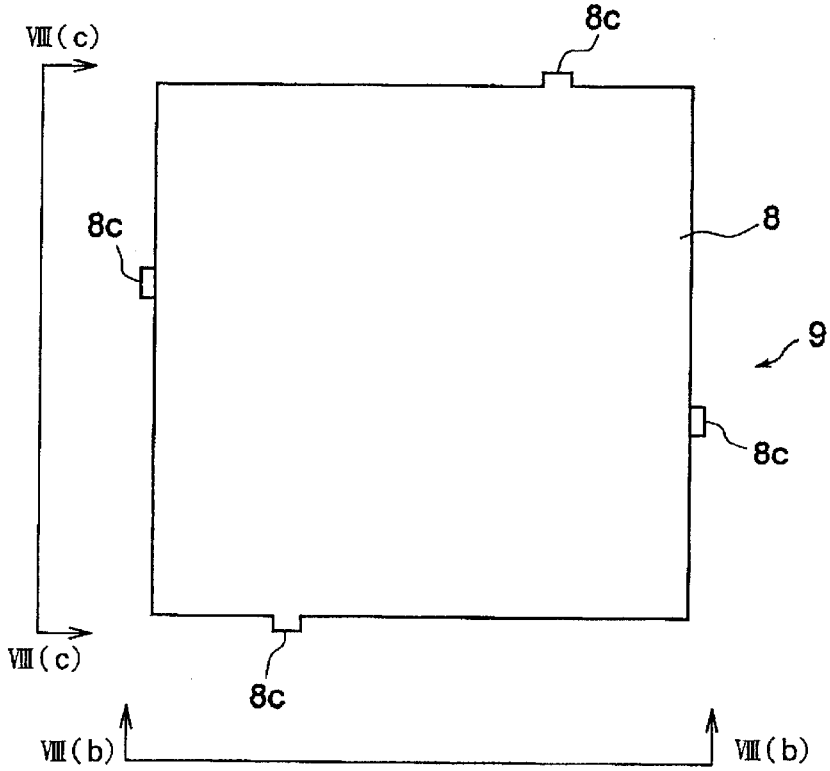
FIG. 8(*a*) is a plan view showing a third arrangement of bridge remainders.
Figure 8B:
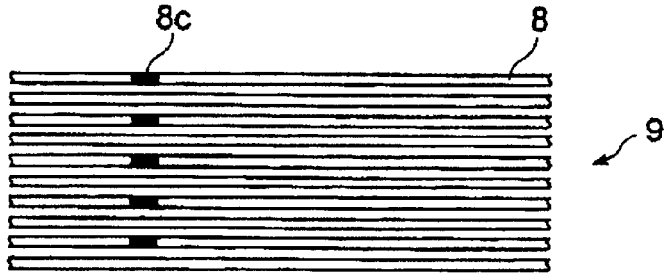
Figure 8C:
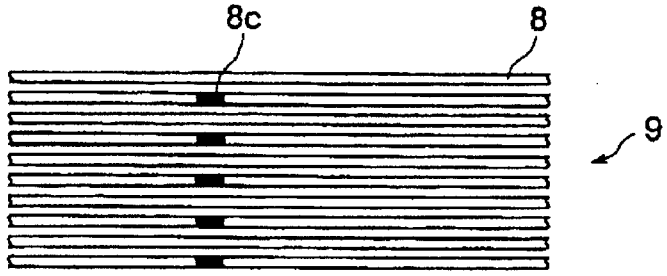

As shown in FIG. 8, it is also possible to alternately stack the dynodes 8 manufactured by the dynode substrate 20 and the dynodes 8 manufactured by the dynode substrate 21 while simultaneously rotating every other dynode 8 by 90 degrees about the imaginary central axis.

Figure 9A:
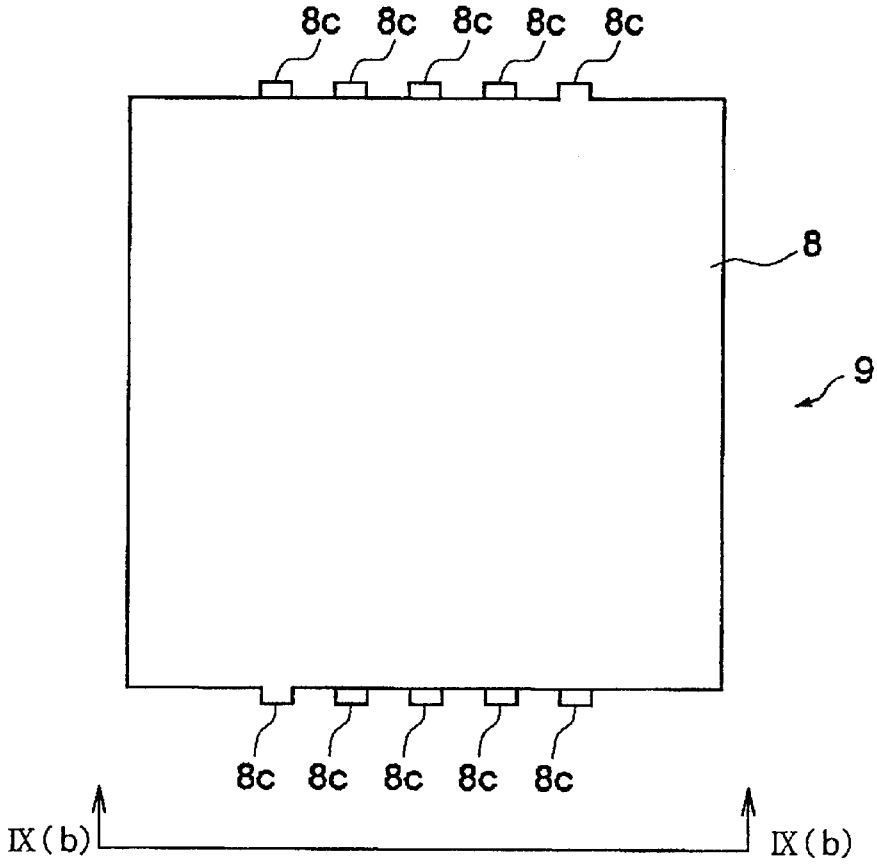
FIG. 9(*a*) is a plan view showing a fourth arrangement of bridge remainders.
Figure 9B:
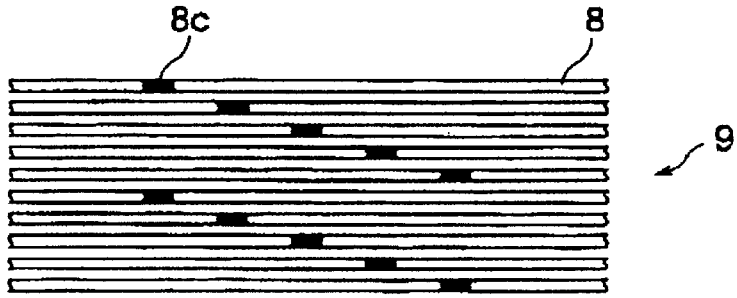

As shown in FIG. 9, the bridge remainders 8*c* can also be arranged in a stepped pattern as viewed from the side. The bridge remainders 8*c* arranged in a stepped pattern can also be formed on all four sides of the electron multiplying section 9, as shown in FIG. 10.

Figure 10A:
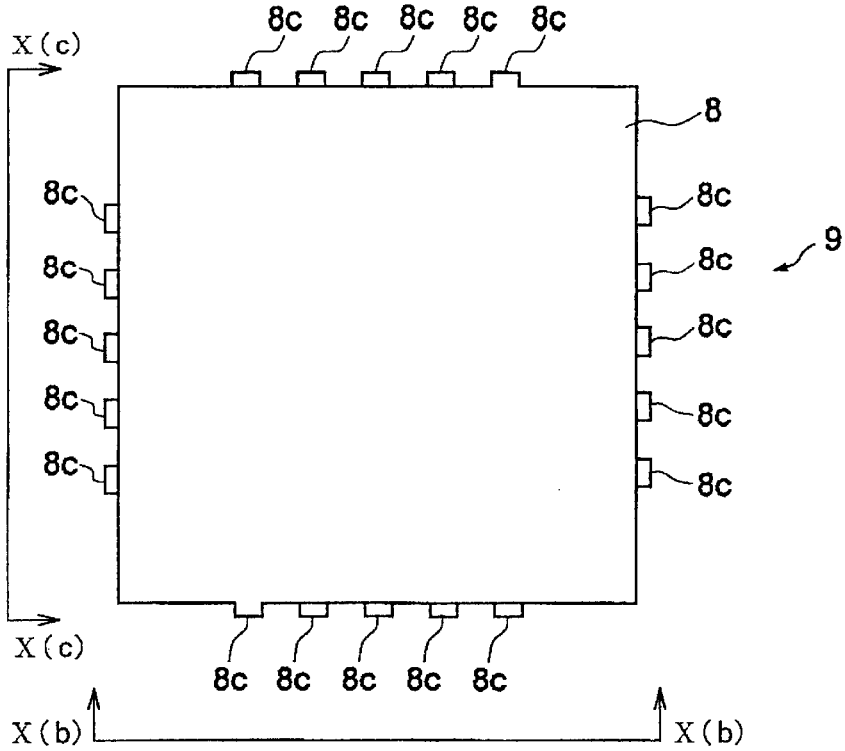
FIG. 10(*a*) is a plan view showing a fifth arrangement of bridge remainder.
Figure 10B:
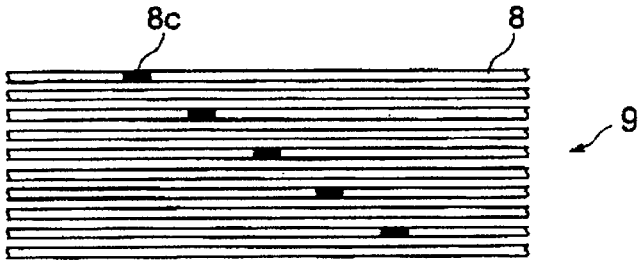
Figure 10C:
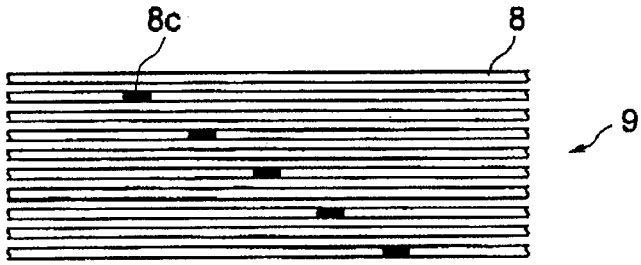

While the connection terminals 25 are not shown in FIGS. 8, 9, and 10, the connection terminals 25 are arranged such that the straight lines passing through the each connection terminals 25 in a direction parallel to the dynode stacking direction do not overlap each other.

Figure 11:
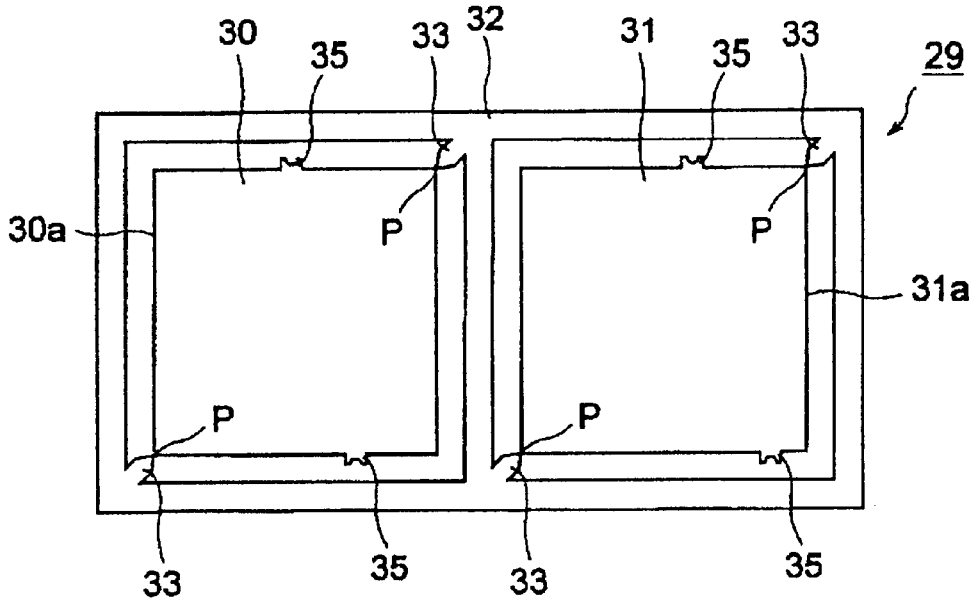
FIG. 11 is a plan view showing a second example of a base plate used in an etching process for forming dynodes.
Figure 12:
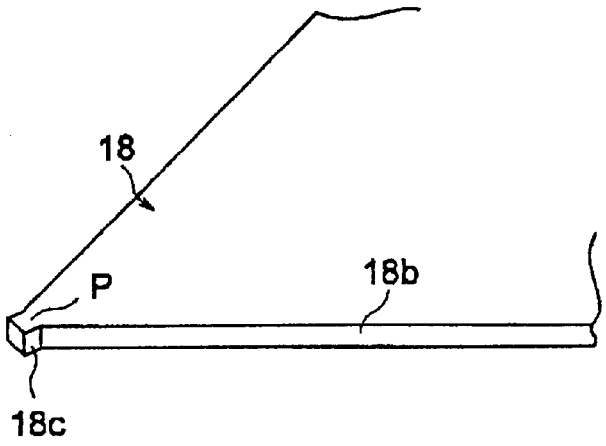
FIG. 12 is a perspective view showing a bridge remainder on a dynode.

The present invention is not limited to the embodiment described above. FIGS. 11 and 12 illustrate a modification of the embodiment. A base plate 29 includes a pattern frame 32 enclosing plate-shaped dynode substrates 30 and 31, which are arranged side by side and have a thickness of 0.2 mm. Bridges 33 link the pattern frame 32 to edges 30*a* and 31*a* of the dynode substrates 30 and 31. Each bridge 33 is positioned on the diagonal of the dynode substrates 30 and 31 and connects to corners P on the edges 30*a* and 31*a*.

After etching the dynode substrates 30 and 31, the dynode substrates 30 and 31 are separated from the pattern frame 32. As a result, as shown in FIG. 12, a small portion of the bridge 33 remains on the corner P a dynode 18. These small portions form bridge remainders 18*c* on the dynodes 18. Each bridge remainder 18*c* appears along the diagonal of the dynodes 18.

Figure 13:
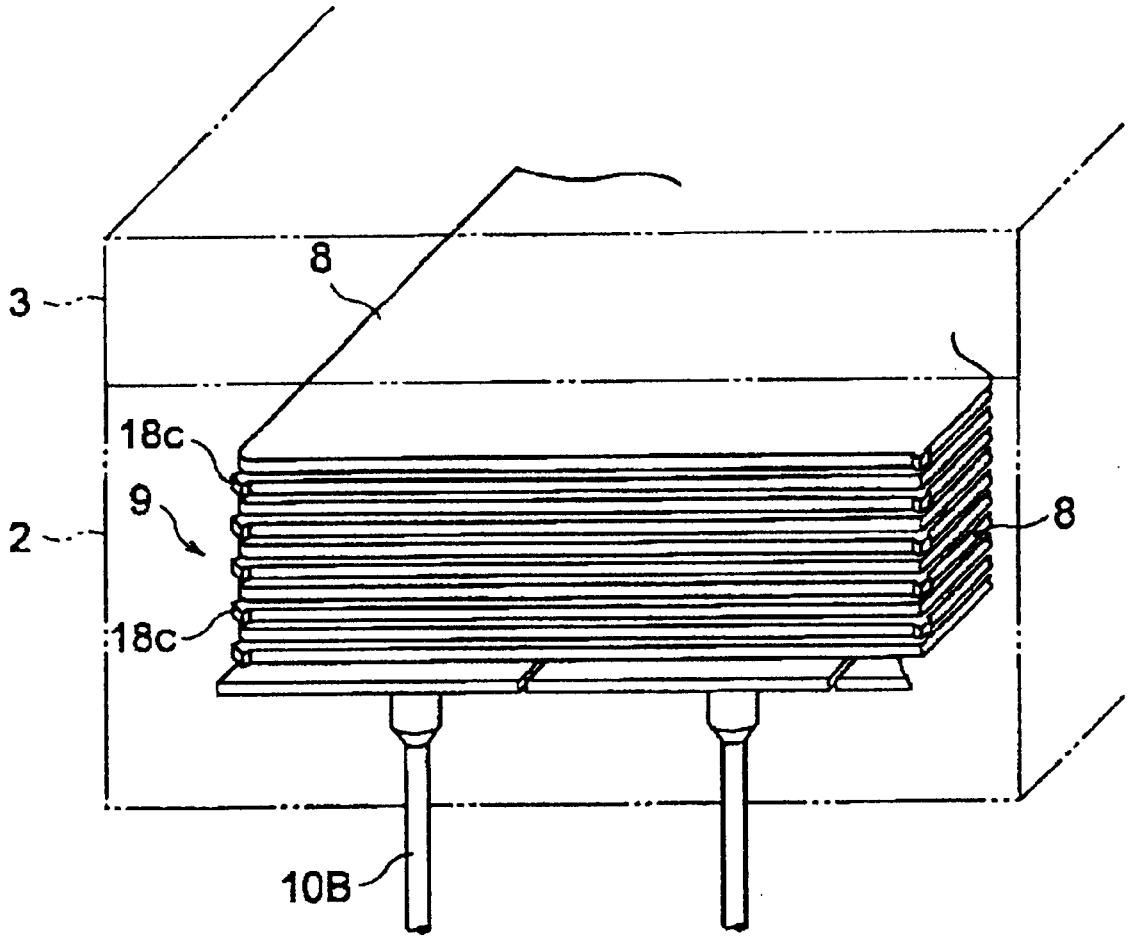
FIG. 13 is a perspective view showing the dynodes of FIG. 12 stacked in a photomultiplier tube.

When the dynodes 18 having these bridge remainders 18*c* are stacked, the bridge remainders 18*c* of neighboring dynodes 18 are arranged in different positions in the stacking direction of the dynodes 18. FIG. 13 shows a specific example. Here, the bridge remainders 18*c* are arranged on all four corners of the dynodes 18, but appearing in any given corner on every other dynode in the stacking direction. As a result, neighboring bridge remainders 18*c* are separated by at least the thickness of a dynode 18, thereby reliably avoiding discharges that may occur in the bridge remainders 18*c*. It should be noted that the numbering 35 (see FIG. 11) represents the connection terminal for connecting the dynode pins 10A.

In the embodiment described above, the bridges 23, 33 connect to the dynode substrate 20, 21, 30, 31 at symmetric positions in relation to the center of the dynode substrate 20, 21, 30, 31. However, these connecting positions can be shifted slightly from these symmetric positions. Further, while the dynodes 8 in the above embodiment are square shaped, these dynodes 8 may also be formed rectangular or polygonal in shape.

INDUSTRIAL APPLICABILITY

The photomultiplier tube of the present invention is employed in a wide range of imaging devices designed for low light intensity ranges, such as surveillance cameras and night vision cameras.

What is claimed is:

1. A photomultiplier tube comprising:

a faceplate;

a photocathode for emitting electrons in response to light incident on the faceplate;

an electron multiplying section housed in a hermnetically sealed vessel for multiplying the electrons emitted from the photocathode; and an anode for transmitting output signals based on the electrons multiplied by the electron multiplying section, wherein the electron multiplying section includes a plurality of plate-shaped dynodes stacked in layers in a stacking direction, each dynode being formed with electron multiplying holes by etching while supporting a base plate in which a frame surrounds the dynode and is connected to edges of the dynode by bridges, the dynode having the edges provided with bridge remainders as a result of removing the dynode from the frame, the bridge remainders being arranged such that straight lines extending parallel to the stacking direction of the dynodes while passing through each bridge remainder on neighboring dynodes do not overlap each other thereby preventing electrical discharges between bridge remainders of neighboring dynodes.

2. The photomultiplier tube as recited in claim 1, wherein the bridge remainders are formed on the edges along edge portions of the dynodes.

3. The photomultiplier tube as recited in claim 1, wherein the bridge remainders are formed on corners along edge portions of the dynodes.

4. The photomultiplier tube as recited in claim 1, wherein the bridge remainders are positioned such that straight lines extending parallel to the stacking direction of the dynodes while passing through each bridge remainder overlap each other in every other layer of the dynodes in the stacking direction.

5. The photomultiplier tube as recited in claim 2, wherein all the bridge remainders are positioned such that straight lines extending parallel to the stacking direction of the dynodes while passing through the each bridge remainder on the dynodes do not overlap one another.

6. The photomultiplier tube as recited in claim 2, wherein the bridge remainders are offset in a stair-shaped arrangement.

7. The photomultiplier tube as recited in claim 2, wherein the bridge remainders are positioned such that straight lines extending parallel to the stacking direction of the dynodes while passing through each bridge remainder overlap each other in every other layer of the dynodes in the stacking direction.

8. The photomultiplier tube as recited in claim 3, wherein the bridge remainders are positioned such that straight lines extending parallel to the stacking direction of the dynodes while passing through each bridge remainder overlap each other in every other layer of the dynodes in the stacking direction.

9. The photomultiplier tube as recited in claim 5, wherein the bridge remainders are offset in a stair-shaped arrangement.

* * * * *